United States Patent [19]

Barriac

[11] 4,238,889

[45] Dec. 16, 1980

[54] DEVICES FOR THE AZIMUTH AND SLOPE SCANNING OF A DRILLING LINE

[75] Inventor: Jacques Barriac, Plaisir, France

[73] Assignee: Societe d'Applications Generales d'Electricite et de Mecanique Sagem, Paris, France

[21] Appl. No.: 962,679

[22] Filed: Nov. 21, 1978

[30] Foreign Application Priority Data

Dec. 2, 1977 [FR] France ..... 77 36334

[51] Int. Cl.[3] ..... G01C 9/06; E21B 47/022

[52] U.S. Cl. ..... 33/304; 33/312

[58] Field of Search ..... 33/304, 313, 312, 302, 33/318

[56] References Cited

U.S. PATENT DOCUMENTS

| | | | |
|---|---|---|---|
| 2,635,349 | 4/1953 | Green | 33/312 |
| 3,384,750 | 5/1968 | Owen | 33/312 X |
| 3,753,296 | 8/1973 | Van Steenwyk | 33/304 |
| 3,896,412 | 7/1975 | Rohr | 33/304 |
| 3,938,256 | 2/1976 | Crocker, Jr. | 33/318 |
| 4,071,959 | 2/1978 | Russell et al. | 33/312 |

*Primary Examiner*—William D. Martin, Jr.

*Attorney, Agent, or Firm*—Lane, Aitken, Ziems, Kice & Kananen

[57] ABSTRACT

A device for continuously measuring the azimuth and slope of a drilling line includes a gyroscope and an accelerometer station disposed in a container suspended from a cable. The gyroscope and the accelerometer station are mounted on an inner frame pivotally mounted on an outer frame on an axis which is perpendicular both to the axis of rotation of the gyroscope and the axis of the drilling line. The outer frame is pivotally mounted in the container on the longitudinal axis of the container. An angular position detector measures the angular movements of the inner frame in relation to the outer frame. A first motor controlled by stabilization error information delivered by the gyroscope and corresponding to one axis of gyroscope sensitivity rotates the inner frame in relation to the outer frame, and a second motor controlled by stabilization error information delivered by the gyroscope and corresponding to a second axis of sensitivity rotates the outer frame in relation to the container. A precession circuit imposes on the gyroscope precession controlled proportionally to the slope of the axis of rotation of the gyroscope in relation to the horizontal plane so as to maintain the axis of rotation in a horizontal plane.

5 Claims, 5 Drawing Figures

DEVICES FOR THE AZIMUTH AND SLOPE SCANNING OF A DRILLING LINE

The invention relates to devices for the azimuth and slope scanning of a drilling line, particularly a drilling line of an oil well.

By the expression "azimuth and slope scanning", is meant the the operation consisting in taking the azimuth and the slope of an existing drilling line with respect to the depth of this drilling line.

As for the expression "azimuth" and "slope", the azimuth means the angle formed by the horizontal projection of the axis of the drilling line with the horizontal projection of the vector of the Earth's rotation, and the slope means the angle formed by the axis of the drilling line with the gravity vector.

The use of devices comprising a gyroscope and an accelerometer for the azimuth and slope scanning of a drilling line is known.

However, the devices known up to present presented a certain number of disadvantages.

These devices were of the magnetometer or free gyro type.

They were inaccurate and required a long and therefore costly setting up.

As for the magnetometer devices, it was necessary to take a reading before positioning of the tubing of the drilling line.

As for the non-slaved free gyro devices, it was indispensable to set the gyroscope on the surface, this setting being effected on an optical North.

Whether the device is of the magnetometer or of the free gyro type, the readings of the drilling line could not take place by continuous travel of the device; it was necessary to allow for stops at all the measuring points, resulting in a long and therefore costly implementation.

The invention has precisely as an aim to remedy these disadvantages.

It is an object of the invention to provide a device which is capable of measuring the azimuth and slope of a drilling line continuously as the device is lowered into the drilling line.

The device according to the invention comprises a gyroscope and an accelerometer station disposed in a container suspended from a cable so as to be able to travel along the drilling line to be scanned.

The gyroscope and the accelerometer station are mounted on an inner frame, which is pivotally mounted on an outer frame on an axis which is perpendicular to both the axis of rotation of the gyroscope and the axis of the drilling line. The outer frame is pivotally mounted in the container on the longitudinal axis of the container. The gyroscope and the accelerometer station each have two axes of sensitivity. A precession circuit internal to the gyroscope imposes on the gyroscope a precession controlled proportionally to the slope of the axis of rotation of the gyroscope in relation to the horizontal plane so as to maintain the axis of rotation in a horizontal plane.

The invention consists, apart from the arrangement which has just been discussed, of certain other arrangements which are used preferably at the same time and which will be more explicitely described hereafter.

The invention will, in any case, be well understood with the help of the complement of description which follows as well as the accompanying drawings, which complement and drawings relate to a preferred embodiment of the invention and have of course no limiting character.

FIG. 1 of these drawings is a schematical perspective view, with parts cut away, of a device constructed in accordance with the invention.

Figure 1:
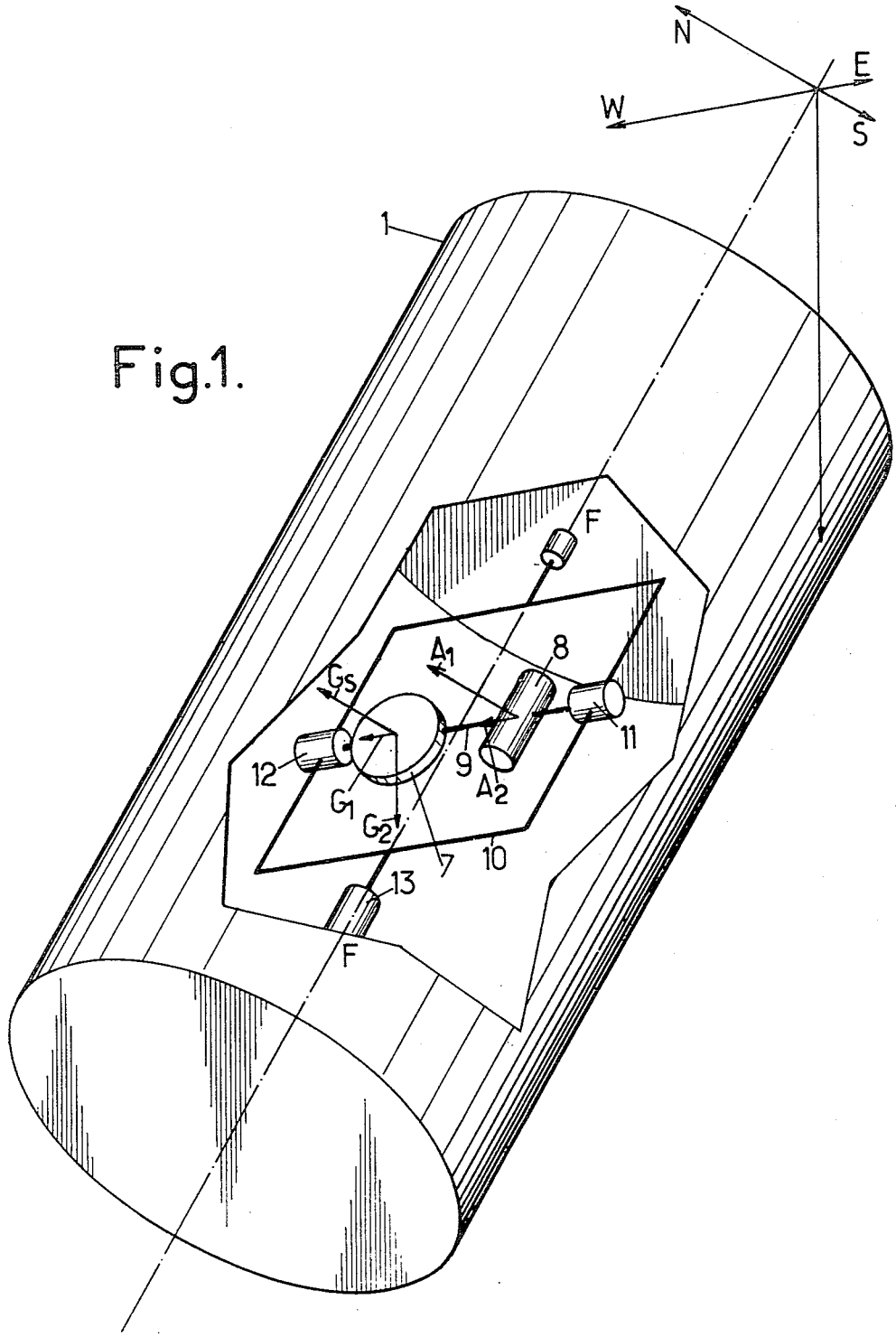

The device of the invention comprises then a gyroscope 7 and an accelerometer station 8 disposed in a container 1 suspended from a cable 2 so as to be able to travel through the drilling line to be scanned 3 which it is assumed (see FIG. 2) to be formed by tubing.

This cable 2 is wound around a winch 4 and passes around a pulley 5; this pulley 5, for example, comprises measuring means 6 delivering a signal $\Delta$ L representing the length of the cable unwound, i.e. the position of container 1 in the drilling line 3.

Gyroscope 7 and the accelerometer station 8 are mounted on an inner frame 9.

This inner frame 9 is pivotably mounted on an outer frame 10 along an axis which is perpendicular, on the one hand, to the axis of rotation $G_S$ of gyroscope 7 and, on the other hand, to the axis FF of drilling line 3.

This outer frame 10 is pivotably mounted in container 1 along the longitudinal axis of said container 1 which is coaxial with axis FF of drilling line 3 during the passage of the container.

Gyroscope 7 is a gyroscope of the double servo-controlled type which is known per se and which will be more explicitly described hereafter.

This gyroscope 7 has two axes of sensitivity, i.e.

a first axis $G_1$ perpendicular to the axis FF of drilling line 3, and a second axis $G_2$ perpendicular to the first axis $G_1$ and oriented so that the plane defined by the axes ($G_1$) and ($G_2$) is vertical.

The accelerometer station 8 is of the servo-controlled mass type and it may advantageously be formed by an accelerometer having two axes of sensitivity.

This accelerometer station has then two axes of sensitivity, i.e.:

a first axis $A_1$ parallel to the axis of rotation $G_S$ of gyroscope 7, and a second axis $A_2$ parallel to the pivoting axis of inner frame 9 in relation to outer frame 10.

An angular position detector 11 is provided for measuring the angular movements of the inner frame 9 in relation to the outer frame 10.

A first motor 12 is provided to rotate the inner frame 9 in relation to the outer frame 10; this first motor 12 is controlled by the stabilization error information delivered by gyroscope 7 and corresponding to its first axis of sensitivity $G_1$.

A second motor 13 is provided to rotate the outer frame in relation to container 1; this second motor 13 is controlled by the stabilization error information delivered by gyroscope 7 and corresponding to its second axis of sensitivity $G_2$.

A precessional circuit internal to gyroscope 7 is provided for imposing on said gyroscope a precession controlled proportionally to the slope of the axis of rotation $G_S$ of gyroscope 7 in relation to the horizontal plane, so as to maintain the axis of rotation $G_S$ of said gyroscope in a horizontal plane and, preferably, in the North-South direction.

This gyroscope 7 comprises an inertia flywheel 14 driven by a motor 15 through a gimbal joint of the Hooke joint type 16. The rotating parts of the gyroscope situated on the other side of the inertia flywheel 14 in relation to gimbal joint 16 are maintained in a housing 17, by means of bearings 18.

Figure 3:
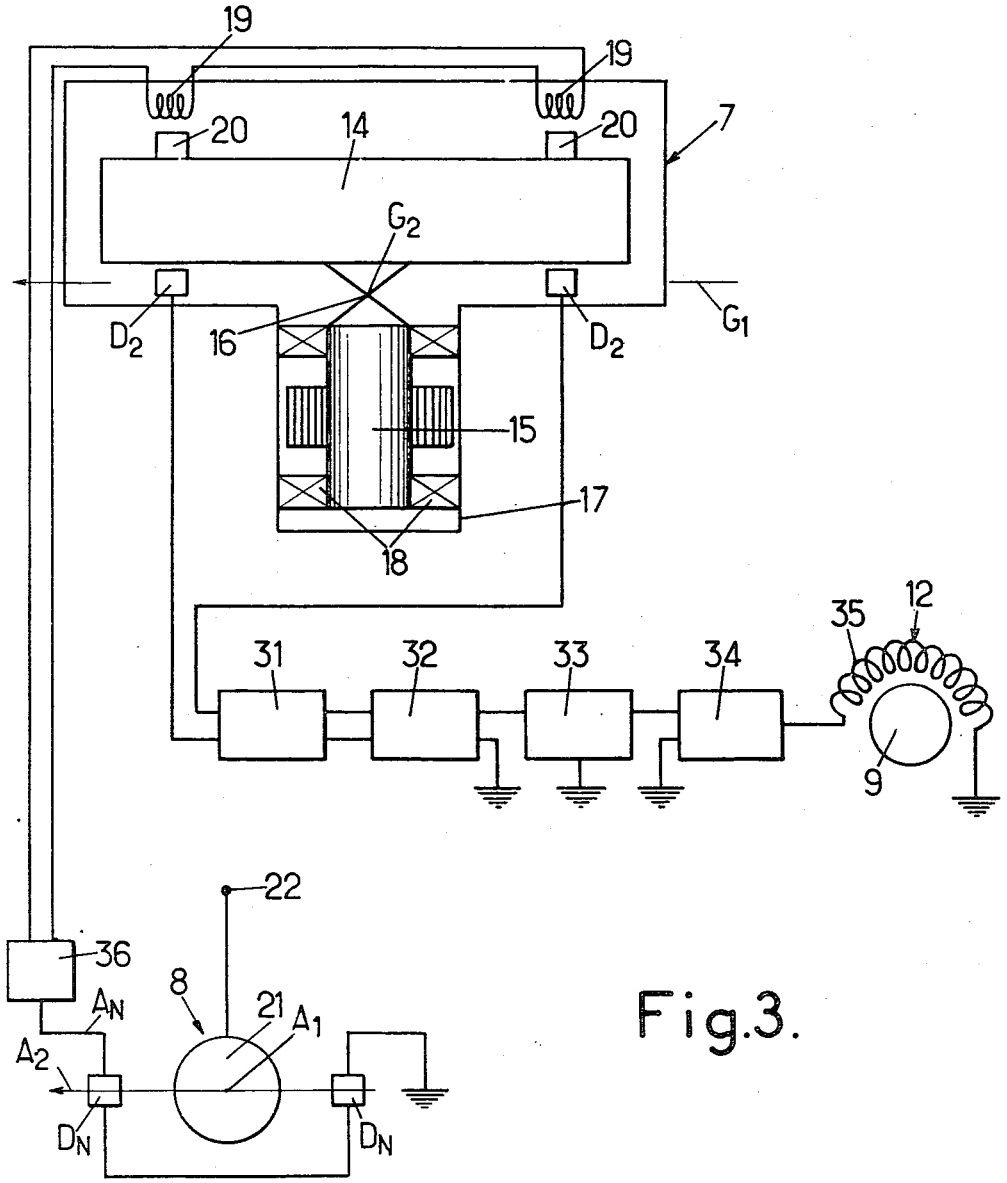
FIG. 3 is a simplified view of the device of FIG. 1 showing the elements which cooperate with one of the axes of sensitivity of the gyroscope.

The detection of the position of the inertia flywheel 14 is carried out by detectors $D_1$ (FIG. 4), and by detectors $D_2$ (FIG. 3).

A precessional torque motor, comprising fixed windings 19 cooperating with elements 20 carried by the inertia flywheel 14, allows a precessional torque to be imposed on said inertia flywheel 14.

As shown in FIG. 3, first motor 12 (provided for rotating the inner frame 9 in relation to the outer frame 10) is controlled by the stabilization error information delivered by detectors $D_2$ of the gyroscope and corresponding to its first axis of sensitivity $G_1$ (axis of sensitivity perpendicular to the axis FF of the drilling line).

In this FIG. 3, the plane in which the precessional torque motor 19, 20 is to be found has been lowered into the plane of the drawing whereas in actual fact said precessional torque motor 19, 20 is in a plane at 90° from that of the drawing.

Figure 4:
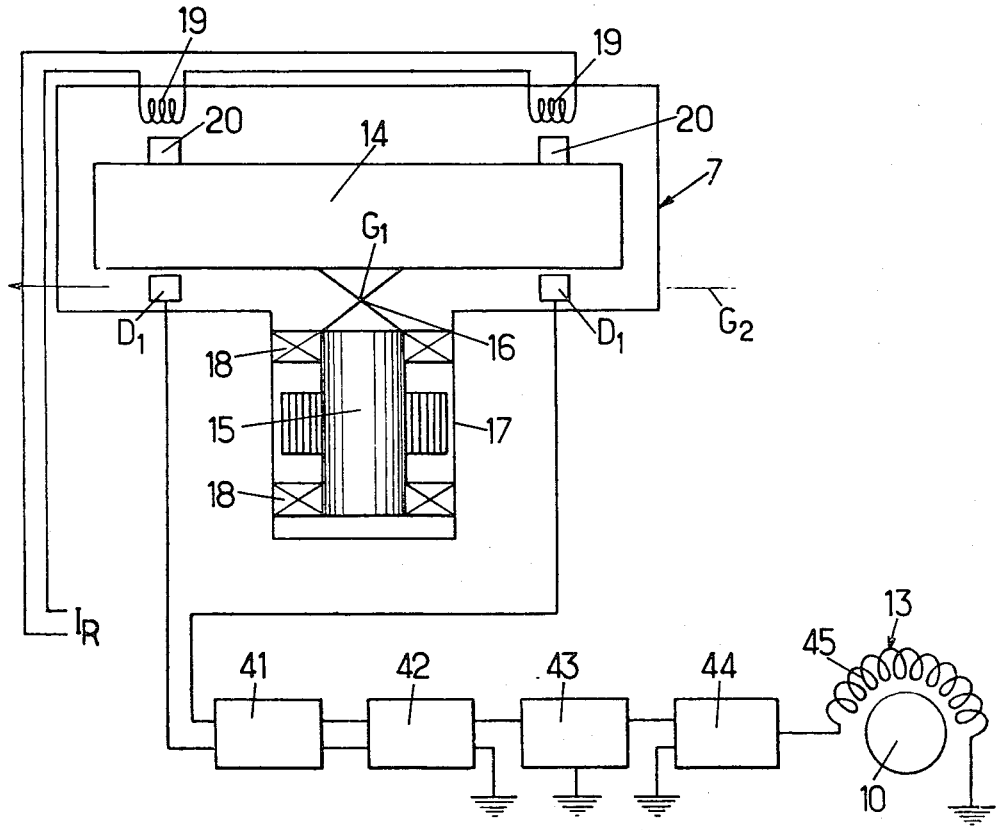
FIG. 4 is a simplified view of the device of FIG. 1 showing the elements which cooperate with the other axis of sensitivity of the gyroscope.
Figure 4:
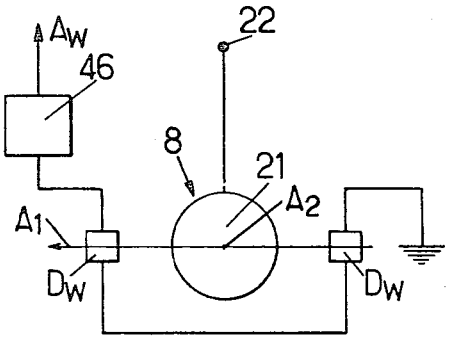

As shown in FIG. 4, the second motor 13 (provided for rotating the outer frame 10 in relation to container 1) is controlled by the error information delivered by detectors $D_1$ of gyroscope 7 and corresponding to its second axis of sensitivity $G_2$ (vertically orientated sensitivity axis).

Figure 5:
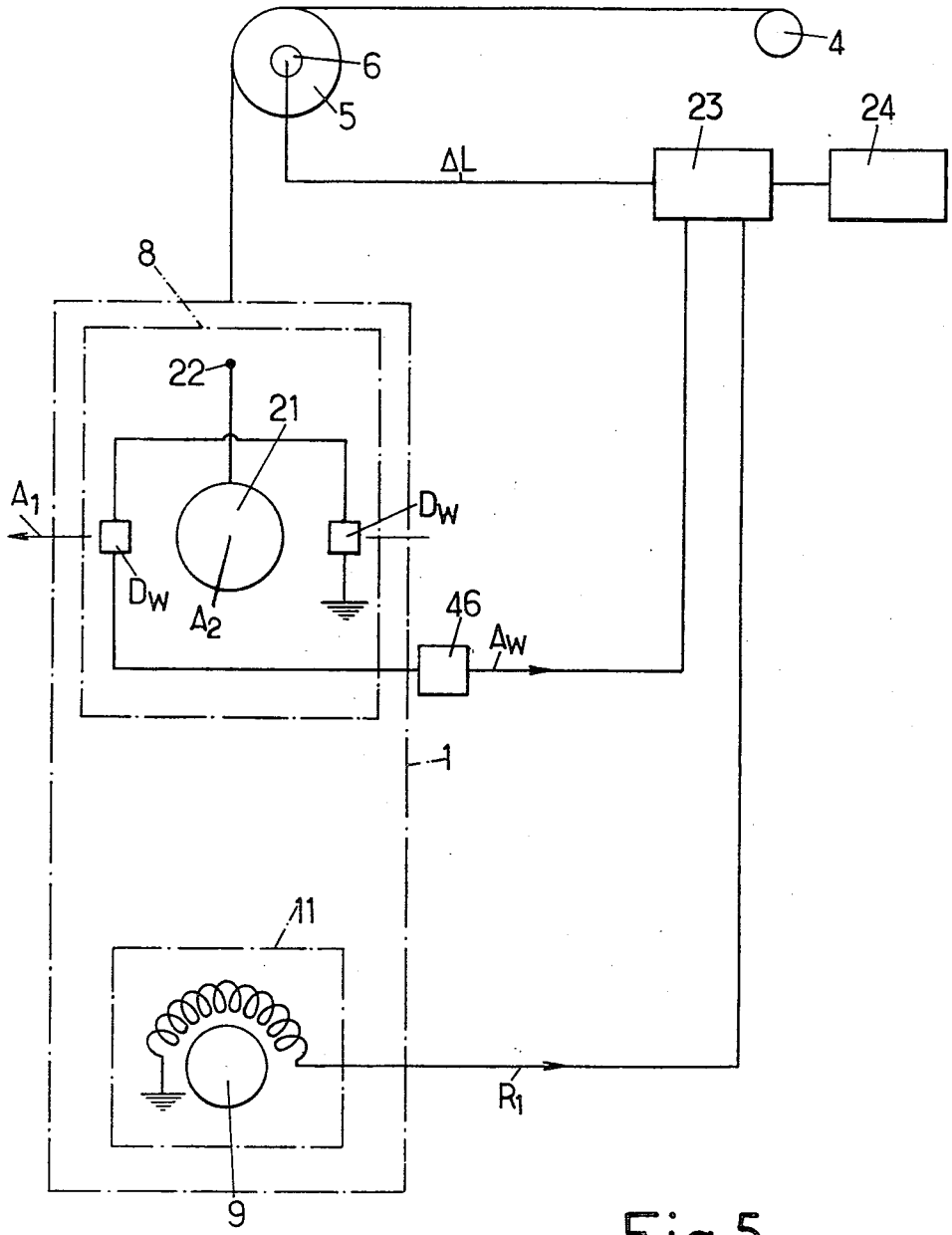
FIG. 5 is a simplified view of the device of FIG. 2 showing the elements whose signals are sent to the ground.

Accelerometer 8 is shown in section along the plane perpendicular to its first axis $A_1$ (in FIG. 3) and in section along the plane perpendicular to its second axis $A_2$ (in FIGS. 4 and 5).

This accelerometer 8 comprises a pendulum mass 21 mounted about a frictionless articulation point 22.

The detection of the position of the pendulum mass 21 is effected by detectors $D_W$ (FIGS. 4 and 5) and by position detectors $D_N$ (FIG. 3).

As shown in FIG. 3, the precessional torque motor 19, 20 of the gyroscope 7 is controlled by the information $A_N$ delivered by the detectors $D_N$ of the accelerometer 8 corresponding to its first axis of sensitivity $A_1$, this so as to cause the precession towards the horizontal of the axis of rotation $G_S$ to gyroscope 7.

On the other hand, in FIG. 4, the precessional torque motor 19, 20 receives a DC current $I_R$ which compensates for the Earth's rotation so as to maintain the axis of rotation $G_S$ of the gyroscope 7 in the meridian plane: this rotation of the Earth represents about 11°/h at a latitude of 45°.

As shown in FIGS. 4 and 5, the information $A_W$, delivered by the detectors $D_W$ of accelerometer 8 corresponding to its second axis of sensitivity $A_2$, are collected to determine the angle formed by the axis FF of the drilling line with the straight East-West line.

In this same FIG. 5, is shown the information $R_1$ delivered by the position detector 11 (position of the inner frame 9 in relation to the outer frame 10) which is collected to determine the angle, projected in the meridian plane, between the axis FF of the drilling line and the axis of rotation $G_S$ of gyroscope 7.

The indication $A_W$ is sent back to the ground, for example by means of a conductor situated in cable 2.

The indication $R_1$ is sent back to the ground, for example through a conductor situated in cable 2.

These two indications $A_W$ and $R_1$ are introduced into a computer 23 which also receives the indication $\Delta$ L representative of the position of the container in the drilling line.

This computer 23 can cooperate with a display and/or recording device 24 which communicates in clear the value of the azimuth and the value of the slope when the measurements are carried out.

Figure 2:
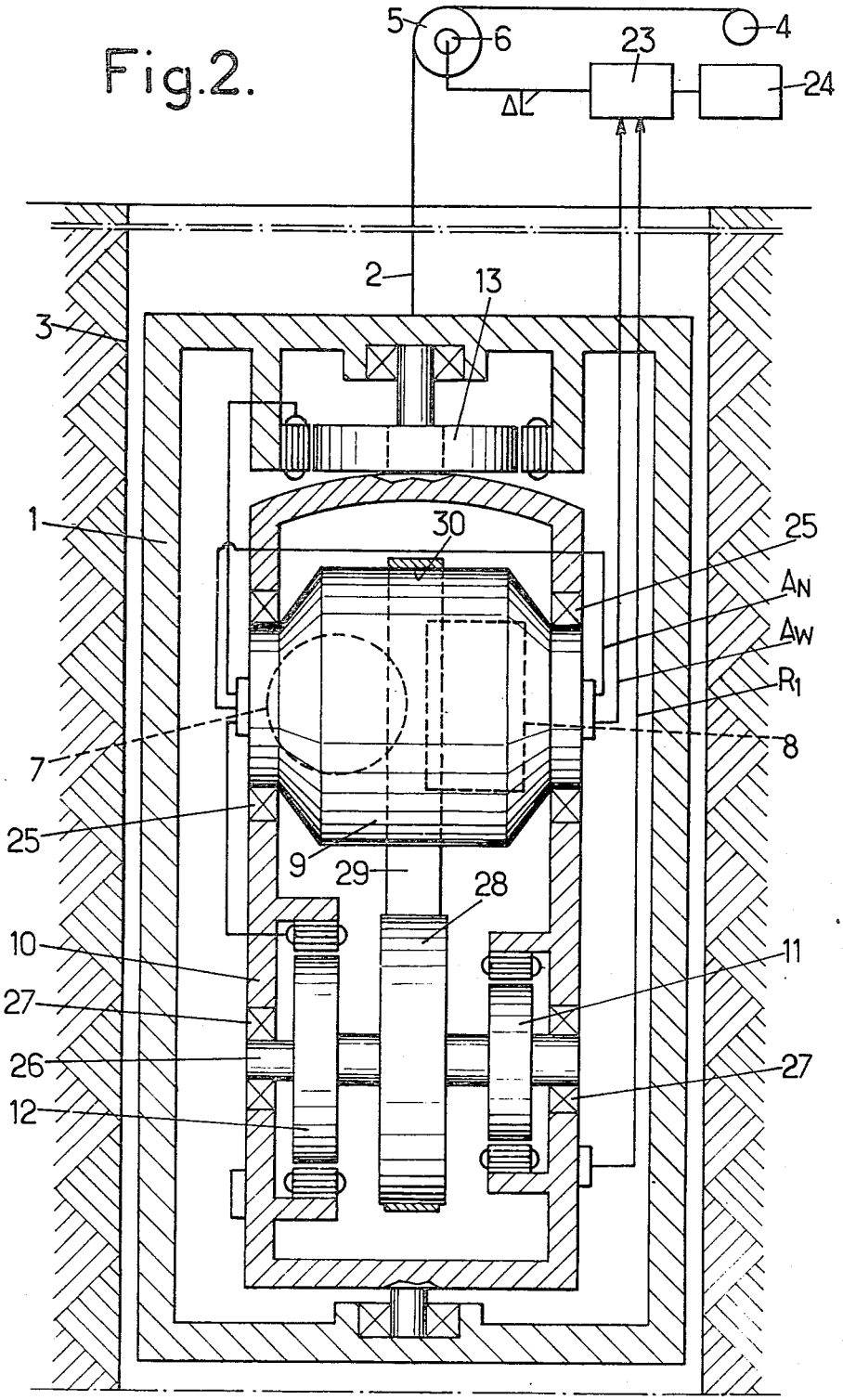
FIG. 2 is a longitudinal section of a device according to the invention constructed according to a particular embodiment.

From the constructional point of view, and as shown in FIG. 2, it is advantageous to have recourse to the arrangement consisting in separating the inner frame 9 from the angular position detector 11 and from the first motor 12.

In fact, the diameter of the container is limited by the diameter of the drilling line.

In these circumstances, the inner frame 9 carries solely the gyroscope 7 and the accelerometer 8, and it is pivotally mounted on the outer frame 10 by means of ball-bearings 25.

The angular position detector 11 and the first motor 12 are disposed on a shaft 26 journalled in outer frame 10 by means of ball-bearings 27. Shaft 26 carries a pulley 28 over which passes a belt 29 which passes over a pulley 30 carried by the inner frame 9, these two pulleys 28 and 30 having the same diameter.

Preferably, shaft 26 is disposed parallel to the pivoting axis of inner frame 9.

To prevent play from occurring in this belt-transmission, the belt 29 is advantageously made of steel.

In so far as the electronic circuits are concerned between the gyroscope 7 and the first and second motors 12 and 13, they may be constructed as shown in FIGS. 3 and 4.

As shown in FIG. 3, the two position detectors $D_2$ are connected to an amplifying detection device 31 which delivers two amplified signals which are introduced into a continuous synchronous demodulator 32.

The signal delivered by this continuous synchronous demodulator 32 is introduced into a corrector network 33 which delivers a signal which is amplified in a power amplifier 34 whose output feeds the winding(s) 35 of the first motor 12.

As shown in FIG. 4, the two position detectors $D_1$ are connected to an amplifying detection device 41 which delivers two amplified signals which are introduced into a continuous synchronous demodulator 42.

The signal delivered by this continuous synchronous demodulator 42 is introduced into a corrector network 43 which delivers a signal which is amplified in a power amplifier 44 whose output feeds the winding(s) 45 of the second motor 13.

In FIG. 3 there is shown a power amplifier 36 which amplifies the signal $A_N$ delivered by accelerometer 8 and which is intended to supply the precessional torque motor 19, 20 of gyroscope 7.

In FIGS. 4 and 5, there is shown a power amplifier 46 which amplifies the signal $A_W$ delivered by accelerometer 8 and which is intended to be used with signal $R_1$ delivered by position detector 11.

In operation, the container 1 is rigidly locked with the ground structure from which the drilling line 3 extends, and then the vector of the Earth's rotation (North) and the gravity vector (vertical) are located, so that the axis of rotation $G_S$ of the gyroscope 7 remains stabilized along the horizontal in the North direction. Then, the container 1 is lowered into the drilling line 3 while the "North memory" function of the gyroscope 7 is maintained.

Then, the measurement of the azimuth and of the slope of the drilling line 3 is initiated, this measurement being able to be carried out continuously.

This measurement is effected by analyzing the indications $A_N$ given by the accelerometer station 8 along its first axis $A_1$, which allow the axis of rotation of the gyroscope 7 to be maintained horizontal, whatever the slope of the axis FF of the drilling line 3, by acting on the precession of the gyroscope 7. The indications $A_W$ given by the accelerometer station 8 along its second axis $A_2$ allow the angle formed by the axis FF of the drilling line 3 with the East-West straight line to be determined. In addition, the indications $R_1$ given by the angular position detector 11 which correspond to the angle, projected in the meridian plane, between the axis FF of the drilling line 3 and the horizontal axis of rotation $G_S$ of the gyroscope 7 are also analyzed.

The indications delivered by the gyroscope 7 on its two axes of sensitivity $G_1$ and $G_2$ are used to drive the first and second motors 12 and 13, respectively, so as to maintain the axis of rotation of the gyroscope 7 horizontal whatever the slope of the drilling line 3, and the indications $A_W$ and $R_1$ are used to calculate the azimuth and the slope of the axis FF of the drilling line 3.

The azimuth is obtained by making the following calculation:

$$\text{Azimuth} = \text{Arc tan}\left(\frac{\cos R_1 \cdot \sin A_W}{\sin R_1}\right) + n\pi.$$

n being equal to 0 or to 1.

The slope is obtained by making the following calculation:

$$\text{Slope} = \frac{\pi}{2} - \text{Arc sin}\sqrt{\sin^2 R_1 + \cos^2 R_1 \cdot \sin^2 A_W}$$

As is evident, and as it follows moreover already from what has gone before, the invention is in no wise limited to those of its embodiments and modes of application which have been more especially considered; it embraces, on the contrary, all variations thereof.

I claim:

1. A device for the azimuth and slope scanning of a drilling line, comprising a gyroscope and an accelerometer station disposed in a container suspended from a cable so as to be able to travel through the drilling line to be scanned, an inner frame and an outer frame, characterized by the fact that, the gyroscope and the accelerometer station are mounted in the inner frame, the inner frame is pivotably mounted in the outer frame along an axis which is perpendicular both to the axis of rotation of the gyroscope and to the axis of the drilling line, the outer frame is pivotably mounted in the container along the longitudinal axis of said container which will be that of the drilling line during the passage of the container, the gyroscope is of the double servo-control type and has two axes of sensitivity ($G_1$, $G_2$), i.e. a first axis ($G_1$) perpendicular to the axis of the drilling line and a second axis ($G_2$) perpendicular to the first axis ($G_1$) and oriented so that the plane defined by the axes ($G_1$) and ($G_2$) is vertical, the accelerometer station is of the servo-controlled mass type and has two axes of sensitivity ($A_1$, $A_2$), i.e. a first axis ($A_1$) parallel to the axis of rotation of the gyroscope and a second axis ($A_2$) parallel to the pivoting axis of the inner frame in relation to the outer frame, an angular position detector is provided for measuring the angular movements of the inner frame in relation to the outer frame, a first motor is provided for rotating the inner frame in relation to the outer frame, this first motor being controlled by the stabilization error information delivered by the gyroscope and corresponding to its first axis of sensitivity, and a second motor is provided for rotating the outer frame in relation to the container, this second motor being controlled by the stabilization error information delivered by the gyroscope and corresponding to its second axis of sensitivity ($G_2$), and a precessional circuit internal to the gyroscope is provided for imposing on said gyroscope a precession controlled proportionally to the slope of the axis of rotation of the gyroscope in relation to the horizontal plane so as to maintain this axis of rotation in a horizontal plane, preferably in a North-South orientation.

2. A device according to claim 1, characterized by the fact that the outer frame is separated from the angular position detector and from the first motor.

3. A device according to claim 2, characterized by the fact that the inner frame carries the gyroscope and the accelerometer station, the position detector and the first motor being disposed on a shaft integral with the inner frame through non-slip transmission means having a 1/1 ratio.

4. A device according to any one of claims 1 to 3, characterized by the fact that the accelerometer station is formed by an accelerometer having two axes of sensitivity.

5. A device according to any one of claims 1 to 3, characterized by the fact that the accelerometer station is formed by two accelerometers having one axis of sensitivity.

* * * * *